United States Patent [19]

Parduhn

[11] 4,135,192

[45] Jan. 16, 1979

[54] ANTENNA MOUNTING DEVICE ATTACHED TO AN AUTOMOBILE TRUNK

[76] Inventor: Alfred P. Parduhn, 14501 Wilson Rd., Edmond, Okla. 73034

[21] Appl. No.: 814,032

[22] Filed: Jul. 8, 1977

[51] Int. Cl.[2] ..... H01Q 1/32

[52] U.S. Cl. ..... 343/715; 248/539

[58] Field of Search ..... 343/713, 715, 880, 881, 343/882; 248/539

[56] References Cited

U.S. PATENT DOCUMENTS

| | | | |
|---|---|---|---|
| 4,028,705 | 6/1977 | Loyd | 343/715 |
| 4,035,806 | 7/1977 | Powell | 343/715 |

OTHER PUBLICATIONS

CB Magazine, Mar. 1976, p. 44.

*Primary Examiner*—Eli Lieberman

*Attorney, Agent, or Firm*—William R. Laney

[57] ABSTRACT

A device for mounting a radio antenna adjacent the trunk opening of an automobile, including a flange-engaging channel bracket having an ear projecting therefrom, and an angulated antenna-supporting strap which includes a plurality of right angle bends, and which is pivotally secured to the channel bracket for pivotation about a horizontal axis when the flange-engaging bracket engages a substantially horizontally extending flange around the automobile trunk.

3 Claims, 4 Drawing Figures

ANTENNA MOUNTING DEVICE ATTACHED TO AN AUTOMOBILE TRUNK

BACKGROUND OF THE INVENTION

Field of the Invention

This invention relates to devices for mounting and supporting an operative radio antenna, and particularly, antenna of the type used in conjunction with citizen's band radios, with such device functioning to permit said mounted antenna to be moved from an operative vertically extending position to a stored, retracted position.

GENERAL DESCRIPTION OF THE PRIOR ART

With the recent popular demand for citizen's band radios, and the tremendous increase in the manufacture and sale thereof, a concomitant problem has been encountered of theft of various parts of the receiving system, or vandalistic destruction of certain parts of the receiving system. Entire radios themselves have been ripped from vehicles in which they are mounted, and in some instances, the antennas have been broken off or bent. Because of the prevalence of theft and vandalistic damage to CB radios and their components, efforts have been made to mount the radios in automobiles in a way which makes theft difficult, and reduces access and the ease with which the components may be seized or damaged.

In an effort to reduce the opportunity for damaging the antenna used on these radios, it has been proposed to make the antenna quickly detachable from sockets when the automobile is parked and left unattended, so that the antenna can be removed and stored some place within the automobile which is not accessible to a vandal or thief.

In some instances, it has also been proposed to make the antenna foldable to a position such that it is out of view or not easily accessible.

BRIEF DESCRIPTION OF THE PRESENT INVENTION

The present invention proposes a new antenna mounting device which can be used for supporting the antenna of a vehicle-mounted radio in an operating position at such time as the radio is in use, but which facilitates the rapid storage of the antenna in an inaccessible location at a time when the vehicle is parked and the radio is not in use. An important aspect of the invention is that it is not necessary to dismount or unscrew or detach the antenna to change its status from an operative one, to one in which it is not in use and is stored in a safe location.

Broadly described, the antenna mounting device of the invention is a structure which is particularly adapted to be mounted at the trunk opening of an automobile. The device includes a flange-engaging channel bracket which is secured in a non-interfering position on the flange which surrounds the trunk opening, and against which the trunk lid fits when it is closed. The flange-engaging channel has an ear projecting therefrom which functions as a pivot point for attachment of an angulated antenna-supporting strap which includes a plurality of right angle bends. When pivotally mounted to the ear of the flange-engaging channel bracket, the antenna-supporting strap can be pivoted to a position in which a portion of the strap extends between the closed trunk lid and the flange of the automobile body which surrounds the trunk opening and out to a position where the supported antenna will extend vertically and thus be in its operative receiving position. By pivotation of the antenna-supporting strap about a horizontal axis at the location where it is attached to the flange-engaging channel bracket, the strap and the antenna which it carries can alternatively be pivoted into a position such that both the angulated antenna-supporting strap and the antenna mounted thereon are completely enclosed within the trunk of the vehicle, and no part of the antenna-supporting device of the invention is visible from outside the vehicle.

An important object of the present invention is to provide a lightweight, inexpensively constructed and economically available antenna-supporting bracket or mounting device which is useful for mounting a radio antenna, and particularly those of the type used on a citizen's band radio, on the flange which surrounds the trunk of an automobile.

Another important object of the invention is to provide a trunk-mounted antenna supporting bracket for supporting a CB antenna in a way such that the antenna can be folded out into a position extending vertically when the trunk is closed and the automobile is in use, or which can alternatively be folded to a different position in which the supporting bracket structure, as well as the antenna it carries, are totally within the trunk of the automobile.

A further important object of the invention is to provide an antenna supporting bracket or mounting structure for supporting a CB antenna at the trunk of an automobile in a way such that, without dismounting or detaching the antenna from the bracket, the antenna can be moved between alternate positions in which it is stored entirely within the trunk, or is partially outside the trunk with the antenna projecting vertically in a position for receiving RF signals.

A further object of the invention is to provide an antenna supporting or mounting structure which is adapted to mount or support an antenna by securement to the flange around the trunk opening of an automobile, which device is constructed to permit it to be adapted to use on automobiles having variations in the size of the trunk opening, and differences in the manner in which the trunk of the vehicle is constructed.

Additional objects and advantages of the invention will become apparent as the following detailed description of a preferred embodiment of the invention is read in conjunction with the accompanying drawings which illustrate the invention.

GENERAL DESCRIPTION OF THE DRAWINGS

FIG. 1 is a side elevation view of the antenna mounting device of the invention, illustrating in full lines the location and appearance of the device from one side thereof at a time when the device is mounted to the flange which surrounds the trunk opening of an automobile. This flange, as well as the trunk lid, are shown in phantom lines, and an alternate position of the antenna mounting bracket is shown in dashed lines. The view here illustrated also shows, in phantom lines, a portion of an antenna carried by the bracket.

DETAILED DESCRIPTION OF A PREFERRED EMBODIMENT OF THE INVENTION

Figure 1:
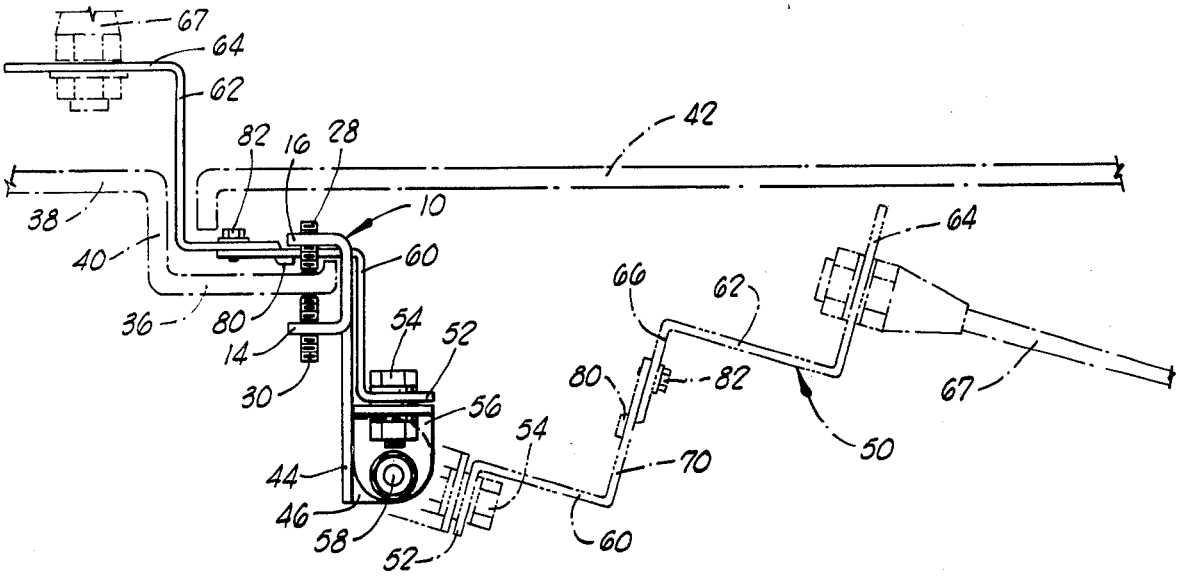

Referring initially to FIG. 1 of the drawings, the antenna mounting bracket or supporting device of the invention includes a flange-engaging channel bracket designated generally by reference numeral 10. The flange-engaging channel bracket 10 is of generally C-shaped cross-sectional configuration at the upper side thereof, and thus includes a web portion 12 and two sets of substantially parallel legs 14, 16 and 18, 20 disposed at opposite ends of the web portion and projecting outwardly therefrom in a right angular fashion. At the center of the web portion 12 and along the upper edge thereof, the web portion has a relief 22 in the form of a rectangular slot formed therein, and this relief is further characterized in having a pair of spaced slots 24 and 26 formed therein. The purpose of the slots 24 and 26 will be hereinafter explained.

Figure 4:
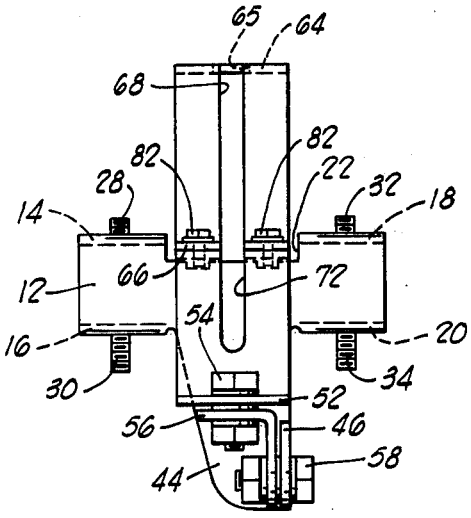
FIG. 4 is a side elevation view of the antenna mounting bracket of the invention with such view being taken after the bracket has been rotated through 90° from the position illustrated in FIG. 1.

Each leg 14–20 of the flange-engaging channel 10 is provided with a central aperture. These apertures accommodate threaded screws 28–34, respectively, as shown in FIGS. 1 and 4. The screws 28–34 are shown in use for the purpose of engagement of a flange 36 which characteristically surrounds and defines the trunk opening of an automobile. Such flange 36 is generally inset into the trunk opening, and thus is displaced downwardly from the rear quarter panel or other outside panel structure 38 of the automobile. An offset or defining wall porton 40 interconnects the panel 38 with the flange 36. In this configuration and location of the flange 36, accommodation is provided for a trunk lid 42 which can close down for mating engagement with the flange 36 when the trunk is closed. Conventionally employed sealing gaskets normally provided on the trunk lid 42 or on the flange 36 or both are not illustrated. It should be pointed out that these gaskets do not interfere with the function and location of the antenna mounting bracket of the present invention.

The flange-engaging channel bracket 10 further includes a downwardly depending plate 44 which occupies a substantially vertical plane and carries an ear 46 at the lower end thereof. The ear 46 also extends in a vertical plane and projects substantially normal to the plate 44.

A second major substructure of the antenna mounting bracket of the invention is an angulated antenna-supporting strap, designated generally by reference numeral 50. This structure is shown in two positions in FIG. 1. The full line position of the antenna-supporting strap 50 is that position which it occupies when the antenna is disposed outside the trunk in a vertically extending operating position. In the dashed line position illustrated in FIG. 1, the angulated antenna-supporting strap 50 has been folded into the interior of the automobile trunk, along with the antenna which it carries.

Figure 2:
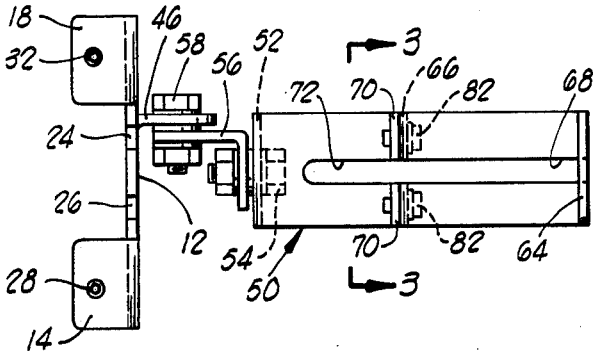
FIG. 2 is a plan view of the antenna mounting bracket of the invention.

The angulated antenna-supporting strap 50 includes a securement plate 52 which carries an aperture for receiving a bolt 54 by which the securement plate is bolted to an angle plate 56 (see FIG. 2). The angle plate 56 has two portions extending at a right angle to each other, with the vertically extending flange or portion thereof being bolted by a suitable bolt 58 to the ear 46 of the flange-engaging channel bracket 10. The angulated antenna-supporting strap 50 further includes a pair of intermediate step portions 60 and 62, and an antenna mounting flange 64. The antenna mounting flange 64 is provided with a central aperture 65 which permits the base of a radio antenna 67 to be bolted or otherwise suitably secured thereto.

Figure 3:
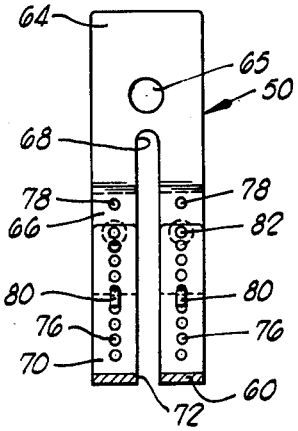
FIG. 3 is a sectional view taken along line 3—3 of FIG. 2.

The step portion 62 is connected to the antenna mounting flange 64 through a right angle bend and is similarly connected at its other end to an adjustment flange 66. The step portion 62, antenna mounting flange 64 and adjusting flange 66 are thus formed from a single metal piece bent at two locations through right angles and, it will be noted in referring to FIGS. 2, 3 and 4, define a centrally disposed, elongated slot 68. The step portion 60, in addition to being joined to the securement plate 52 through a right angle bend, is similarly joined to an adjusting flange 70 through a right angle bend. The thus angulated metal piece which includes the securement plate 52, step portion 60 and adjusting flange 70 is also characterized in having a centrally disposed slot 72 formed therein.

The slotted adjusting flanges 66 and 70 are each characterized, by reason of the central slots 68 and 72 therein, in having a pair of spaced legs. Each of the legs is characterized in having a plurality of spaced apertures therein. Thus, in referring to FIG. 3, it will be noted that the spaced toes of the adjusting flange 70 include a plurality of apertures 76, and that a similar series of spaced apertures 78 is formed in the spaced legs of the adjusting flange 66. At the ends of the spaced toes of the adjusting flange 66, a pair of engaging studs or fingers 80 are bent downwardly out of the major plane of these toes, and through a right angle so as to form hooks which may be passed through and engaged with selected ones of the apertures 76 in the spaced legs of the adjusting flange 70. It should also be pointed out that the spacing and size of the apertures 76 and 78 in the spaced toes of the adjusting flanges 70 and 66, respectively, are such that pairs of apertures in the adjusting flange 66 can be aligned with pairs of apertures 76 in the adjusting flange 70, and suitable securing screws 82 then passed through selected aligned apertures. The concurrent and cooperative use of the engaging fingers 80 and the screws 82, along with the provision of the adjustable registration of the apertures 76 and 78 in the spaced legs of the adjusting flanges 66 and 70, facilitate interengagement of the adjusting flanges 66 and 70 so that the spacing between the step portions 60 and 62 of the angulated antenna-supporting strap 50 can be selectively varied.

In the use of the antenna supporting bracket or mounting device of the invention, the flange-engaging channel bracket 10 is positioned so that the legs 14–20 project over and straddle the flange 36 which surrounds the trunk opening of the automobile. The inner edge of this flange 36 is thus received in the interior of the channel at the upper end of the channel bracket 10, and the channel bracket can be firmly retained in this position by screwing the screws 28–34 downwardly into engagement with the trunk flange 36. With such securement, the antenna mounting bracket is now in its operative position.

It should be pointed out that for various makes and models of automobiles, it may be necessary, as a result of trunk size and the particular manner in which the trunk lid 42 engages and overlaps the trunk flange 46, to slightly adjust the distance which separates the step portion 62 of the angulated antenna-supporting strap 50 from the web portion 12 of the channel bracket 10. This can be accomplished through the use of the screws 82 and hook fingers 80 as engaged and passed through selected ones of the registering apertures 76 and 78 in the manner hereinbefore described. One selected position which may be desirable in the manner of the relative positioning of the adjustment flanges 66 and 70 in relation to each other is accommodated by the inclusion of the notches or slots 24 and 26 in the lower edge or bottom of the relief 22 formed in the web 12. This is to say that the screws can, in one position of adjustment of the adjustment flanges 66 and 70, receive and accommodate portions of the screws 82 as necessary to achieve this relative position of the adjusting flanges.

With the antenna mounting bracket mounted on the flange 36 of the trunk of the automobile in the manner described, the angulated antenna-supporting strap 50 can be folded outwardly to the position shown in solid lines in FIG. 1 at a time when it is desired to place the antenna 66 in use. Such folding action is facilitated by the pivotal interconnection of the ear 46 and the angle plate 56 by means of the bolt 58. When the angulated antenna-supporting strap 50 is folded out to the position shown in full lines in FIG. 1, the method by which the trunk lid 42 interfits with the flange 36, in conventional automobile construction is such that no interference with the closing of the trunk occurs by reason of the extension of the very thin adjusting flange 66 between the edge of the lid 42 and the flange 36 at their closest point of approach at the time when the trunk lid is closed.

When it is desired to store the antenna 66 within the trunk when the automobile is parked, and the radio is not in use, the angulated antenna-supporting strap 50 is pivoted about the horizontal axis of pivotation constituted by the bolt 58, and is moved from the full line position shown in FIG. 1 into the dashed line position in which both bracket and antenna are located entirely within the closed trunk of the automobile.

Although a preferred embodiment of the invention has been herein illustrated and described, it will be appreciated that various changes and innovations in the described and illustrated structure can be effected without departure from the basic principles of the invention. Changes and innovations of this type are therefore deemed to be circumscribed by the spirit and scope of the invention, except as the same may be necessarily limited by the appended claims or reasonable equivalents thereof.

What is claimed is:

1. A device for mounting an antenna upon the perimeter of an automobile trunk opening comprising:

a channel bracket of C-shaped cross-sectional configuration having an opening therein for engaging a flange surrounding an automobile trunk opening;

an ear projecting from the channel bracket in a direction opposite from the opening therein;

an angulated antenna-supporting strap pivotally connected at one of its ends to said ear for pivotation between a first location within said trunk and a second location predominantly outside said trunk, and having a plurality of right-angle bends therein spaced from the ends thereof and from each other, said supporting strap comprising:

a first intermediate step portion having a right angular bend therein and including an adjusting flange on one side of said bend having a plurality of spaced apertures therethrough; and a second intermediate step portion having a right angular bend therein and including an adjusting flange on one side of said bend having a plurality of spaced apertures therethrough; and means adjustably connecting said first and second step portions to each other by extension through selected aligned apertures in said step portions to facilitate spacing the ends of said supporting strap from each other to accommodate the antenna to mounting upon vehicles having different trunk flange widths.

2. A device as defined in claim 1 and further characterized as including an angle plate including:

a first portion pivotally bolted to said ear; and a second portion extending at a right angle to said first portion and pivotally bolted to an end portion of said strap.

3. An antenna mounting device as defined in claim 1, wherein said channel bracket is centrally relieved to accommodate said adjusting flange of said first intermediate step portion in said relief when said angulated antenna supporting strap is in a folded out, operative position.

* * * * *